US006640769B2

(12) United States Patent
Nomura et al.

(10) Patent No.: US 6,640,769 B2
(45) Date of Patent: Nov. 4, 2003

(54) ENGINE LUBRICATION STRUCTURE

(75) Inventors: Akifumi Nomura, Saitama (JP); Yasuo Shimura, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/199,014

(22) Filed: Jul. 22, 2002

(65) Prior Publication Data

US 2003/0037758 A1 Feb. 27, 2003

(30) Foreign Application Priority Data

Aug. 22, 2001 (JP) ..... 2001-298476

(51) Int. Cl.[7] ..... F01M 1/00

(52) U.S. Cl. ..... 123/196 R; 123/195 C; 123/195 R

(58) Field of Search ..... 123/196 R, 195 R, 123/195 C, 196 CP; 184/6.13

(56) References Cited

U.S. PATENT DOCUMENTS 5,887,564 A * 3/1999 Kawamoto ..... 123/196 R
5,975,041 A * 11/1999 Narita et al. ..... 123/196 R
6,497,211 B2 * 12/2002 Nomura et al. ..... 123/196 R

FOREIGN PATENT DOCUMENTS

JP 2000282826 A 10/2000

* cited by examiner

*Primary Examiner*—Tony M. Argenbright
*Assistant Examiner*—Katrina B. Harris
(74) *Attorney, Agent, or Firm*—Birch, Stewart, Kolasch & Birch, LLP

(57) ABSTRACT

A lubrication structure of an engine arranged so as to reduce the size and weight of an engine. A lubrication structure that utilizes a lead valve and a strainer that are placed close together and divided by a partition, prevents air from being sucked into a strainer at the same time as reducing the amount of air in the engine oil. In this structure the oil is supplied to the oil pan from an oil exhaust port open to a small partition partitioned by a rib. The oil exhaust port communicates with an oil reservoir in a lower part of a crankcase via a lead valve. Oil sent from the oil exhaust port includes air. However, the air is separated by providing the rib. The oil in the oil pan is sucked through the strainer by the oil pump.

19 Claims, 5 Drawing Sheets

ENGINE LUBRICATION STRUCTURE

CROSS-REFERENCE TO RELATED APPLICATIONS

The present application claims priority under 35 USC 119 to Japanese Patent Application No. 2001-298476 filed on Aug. 22, 2001 the entire contents thereof is hereby incorporated by reference.

BACKGROUND OF THE INVENTION

1. Field of the Invention

The present invention relates to a lubrication structure of an engine for reducing the amount of air in the engine oil. The lubrication structure enables a compact layout.

2. Description of the Background Art

Published unexamined Japanese patent application No. 2000-282826 provides a structure wherein oil at the bottom of a crankcase in an oil reservoir is distributed to a transmission case for lubrication through a lead valve accomplished by the rotation of a crank web.

SUMMARY OF THE INVENTION

As oil is sucked through a strainer at the bottom of a transmission case and circulated through an engine via an oil pump the distance between the lead valve and the strainer is extended. Furthermore as oil passages between lead valve and the strainer are installed around or near the crankcase, this distance is extended to a greater extent. Therefore, to decrease the weight and decrease the size of an engine by decreasing the size of the lubrication structure, it is desirable that a lead valve and a strainer be brought close together. However, oil sent from the lead valve includes air. It is desirable to prevent the air rich oil from being sucked in through the strainer. Accordingly, the object of the invention is to arrange a lead valve closer to the strainer and preventing air rich oil from being sucked in through the strainer by the oil pump.

The present invention, which has solved the above-mentioned problem, relates to a lubrication structure of an engine comprising a case including a crankshaft, a connecting rod, a piston, and a second case including an oil pan provided at the bottom of the engine. Each case being coupled together via a lead valve. Oil in the oil pan is sucked through a strainer and the exit from the lead valve is separate from the oil pan. A partition for separating air mixed in the oil is provided between the strainer in the oil pan and the lead valve exit.

The sealed case housing the crankshaft, the connecting rod, and the piston and a second case, including the oil pan, are separate. Both cases are connected via the lead valve and the strainer is arranged near the lead valve. Oil that lubricates the crankshaft and the piston is emptied into the oil pan via the lead valve by the reciprocation of the piston. Due to the reciprocation of the piston, oil is prevented from reversely flowing back through the lead valve.

Oil sent from the lead valve includes undesirable air. However, the air can be separated by providing a partition between the exit from the lead valve and the strainer. As a result, a compact layout of the lubricating device, less air in the oil, and the prevention of air from being included in the oil can be accomplished, while decreasing the weight of the engine by decreasing the size of the lubrication structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
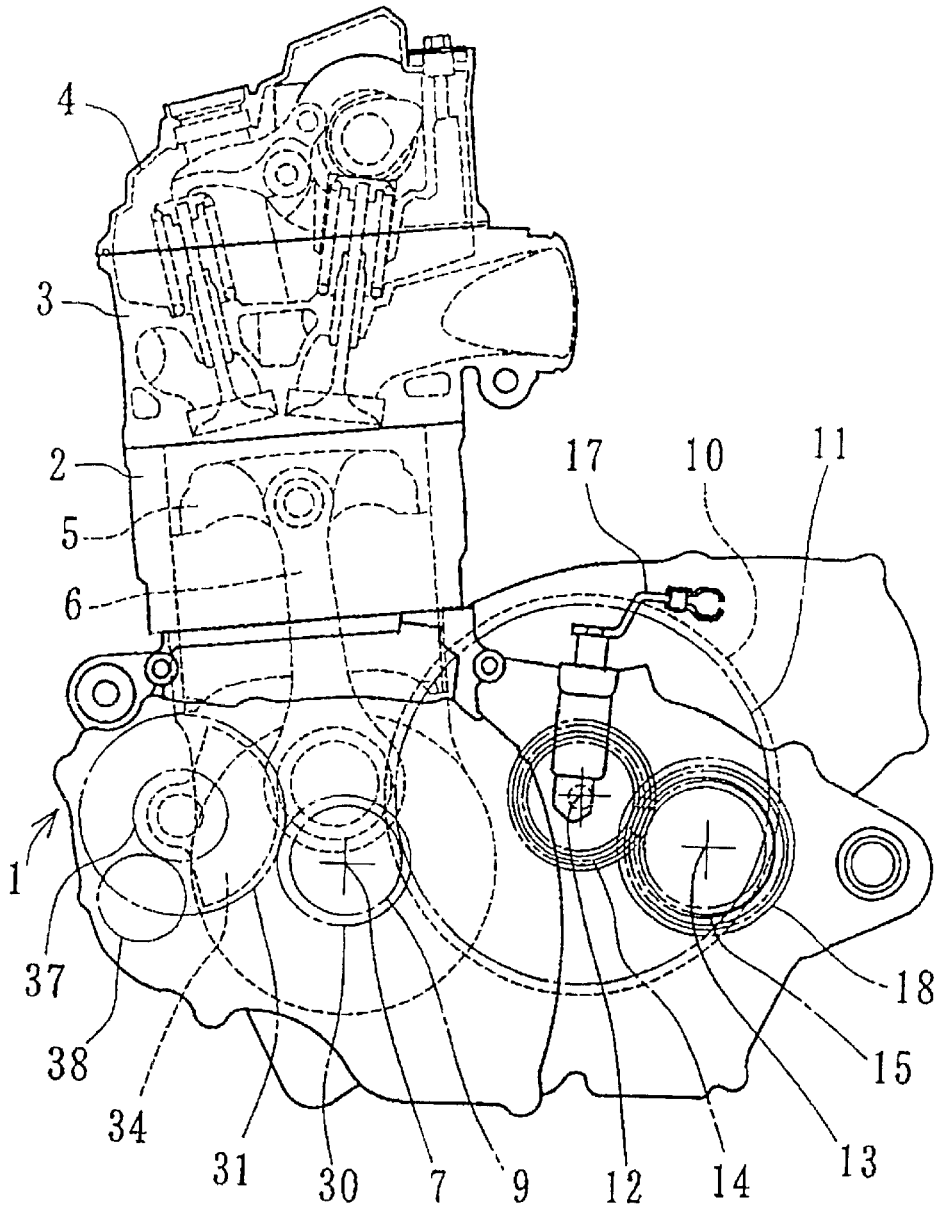
FIG. 1 is a left side view showing a water-cooled four-cycle engine to which this embodiment is applied.

As shown in FIG. 1, the engine includes a cylinder block 2 that is provided over a crankcase 1. A cylinder head 3 and a cylinder head cover 4 are provided on/over the cylinder block 2. A piston 5 is slid in the cylinder block 2 so that it can be reciprocated to rotate the crankshaft 7 (the reference number indicates the center) via a connecting rod 6. The crankshaft 7 is housed in the crankcase 1 and is engaged with a primary driven gear 11 integrated with a clutch 10 via a primary drive gear 9 provided on the crankshaft 7.

The main shaft 12 and the countershaft 13 (the reference numbers indicate the respective center), respectively forming a transmission mechanism, are arranged in parallel with the crankshaft 7 and plural transmission gears 14 and 15, provided on the respective shafts, are always engaged. The transmission gears 14 and 15 are housed in a transmission case in the crankcase 1. The main shaft 12 is connected to the clutch 10 and intermittently operates the clutch 10 by a clutch lever 17. The combination of the transmission gears 14 and 15 is selected by a well-known gear selecting mechanism and a shift is output to an output sprocket 18 provided to one end of the countershaft 13.

Figure 2:
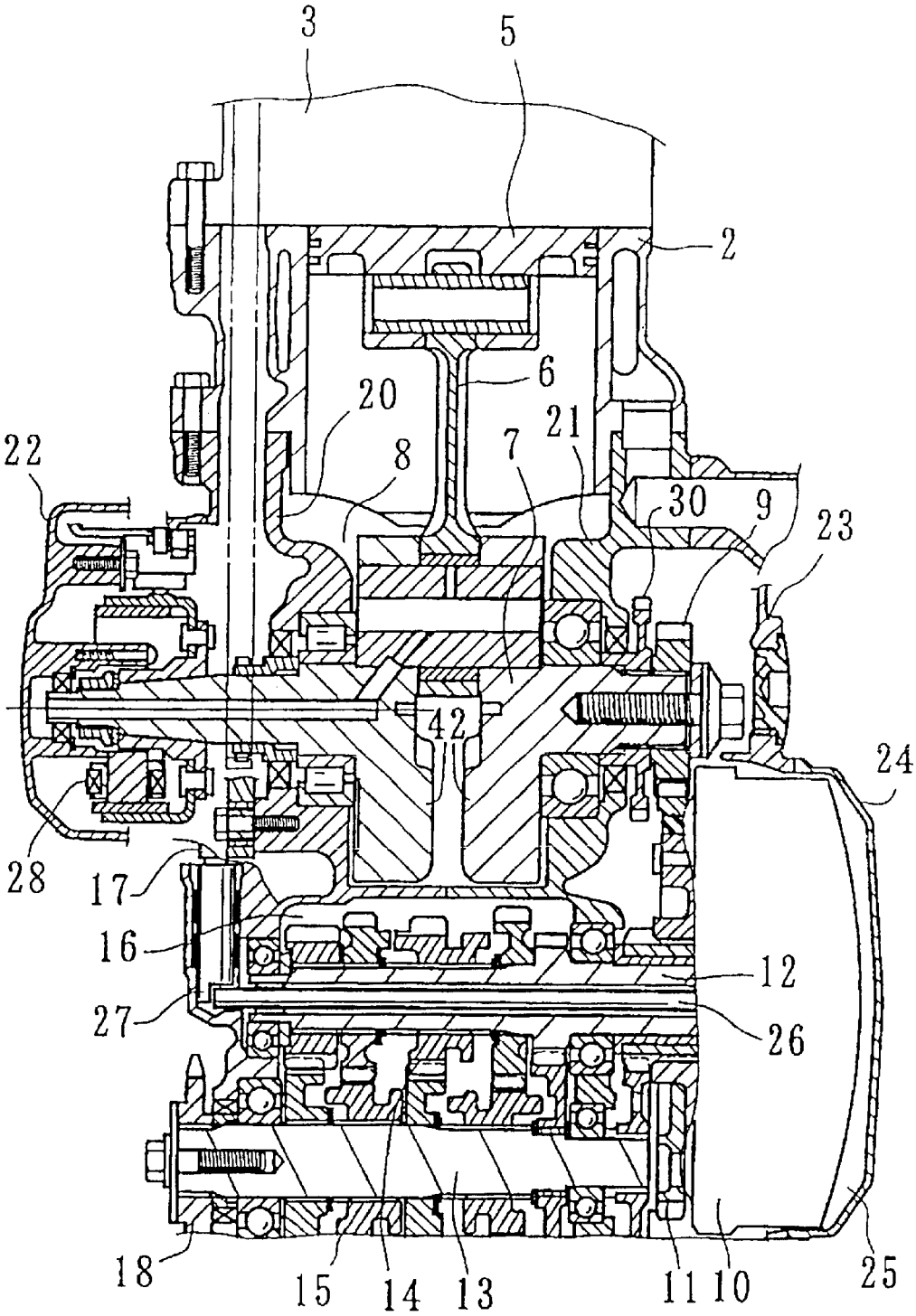
FIG. 2 is a sectional view showing a main part of the engine.

As shown in FIG. 2, the crankcase 1 is divided into right and left parts. The crankcase is composed of a case L 20 on the left side and a case R 21 on the right side, and a case L cover 22 and a case R cover 23 are attached to the respective outsides.

The crankshaft 7, the main shaft 12, and the countershaft 13 are respectively supported by a bearing between the case L 20 and the case R 21. The crankcase 8, which houses the crankshaft 7, forms a seal around the crankshaft 7 between the case L 20 and the case R 21. The transmission mechanism, including the main shaft 12, the countershaft 13, and the transmission gears 14 and 15, is housed in a transmission case 16 formed between the case L 20 and the case R 21 next to the crankcase 8. The crankcase 8 is partitioned from transmission case 16 forming a seal. A clutch housing 25, housing a wet clutch, is formed among the case R 21, the case R cover 23, and a clutch cover 24.

The main shaft 12 connected to the clutch 10 is a hollow shaft. A push rod 26 pierces the main shaft and the clutch is intermittently operated by pushing one end of the push rod by a cam 27 formed at one end of the clutch lever 17. ACG 28 is provided at one end of the crankshaft 7.

Figure 3:
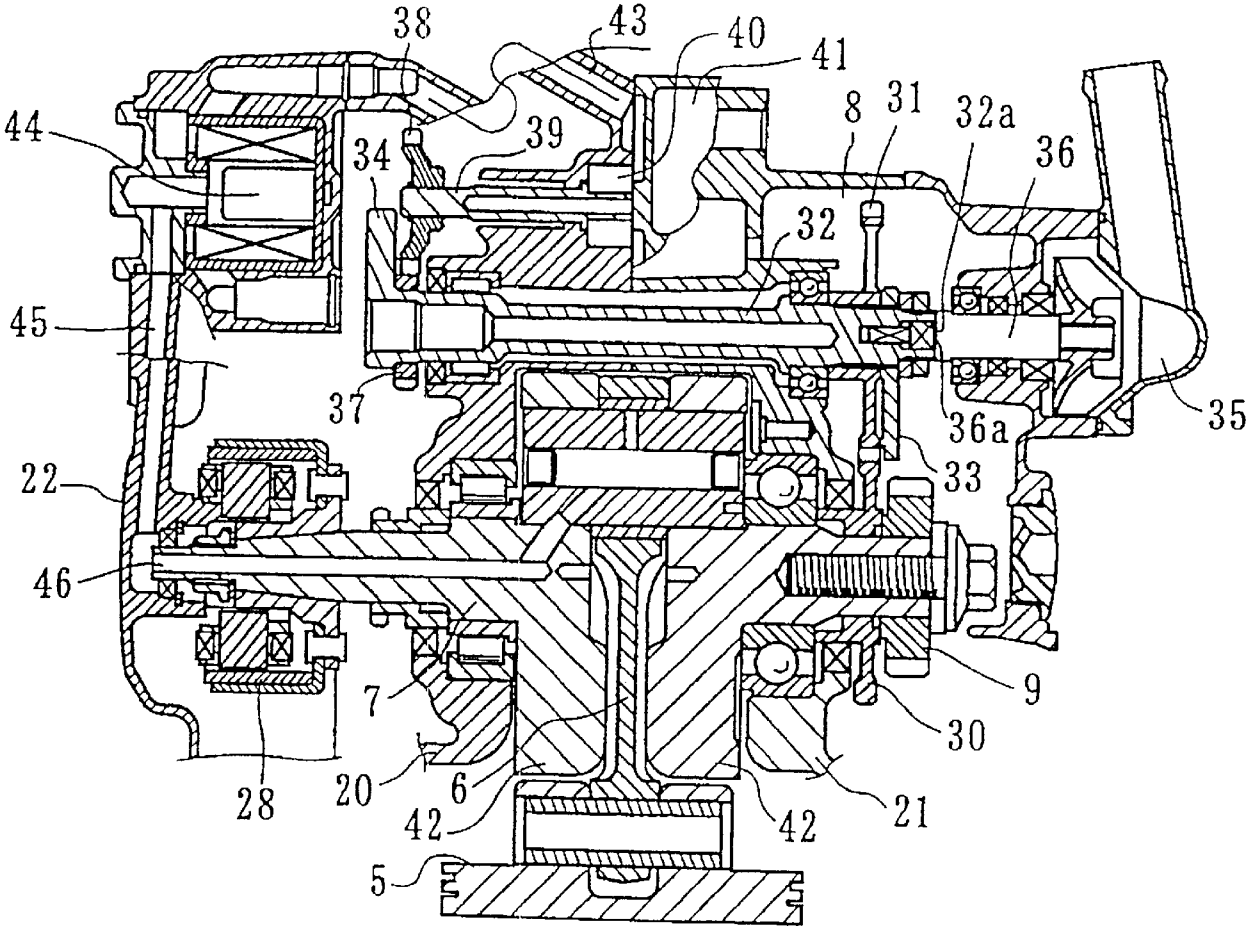
FIG. 3 is a sectional view showing a balancer mechanism.

As shown in FIG. 3, a balancer drive gear 30 is provided in the vicinity of the primary drive gear 9 on the crankshaft 7, and a balancer driven gear 31 engaged with the balancer drive gear is provided at one end of a balancer shaft 32. The balancer shaft 32 is arranged in parallel with the crankshaft 7, supported between the case L 20 and the case R 21, and balance weights 33 and 34 are provided at both ends. One balance weight 33 is provided separately from the balancer driven gear 31 and with one balance weight axially overlapped with the balancer driven gear, and the other balance weight 34 is integrated with the other end of the balancer shaft 32.

An axial fitting hole 32*a* is provided at the end of the balancer shaft 32 where the balance weight 33 is located. Driving shaft end 36*a* formed on a driving shaft 36 of a water pump 35 is fitted into the axial fitting hole and is coupled to the axially fitting hole so that they can be coaxially rotated thus driving the water pump 35 together with the balancer shaft 32.

A separate gear 37 is attached to the balancer shaft 32 near the other balance weight 34 so that the gear can be integrally rotated. The gear 37 is engaged with an oil pump gear 38. The oil pump gear 38 rotates an integrated driving shaft 39 and drives an oil pump 40. The driving shaft 39 is supported by the case L 20 in parallel with the balancer shaft 32. The oil pump 40 is formed on the side of the case L 20 and is partially combined with the case R 21.

For the supply of oil to the oil pump 40, oil is sent from an oil reservoir 41 formed at the bottom of the case R 21 of the crankcase 8 to an oil pan via a lead valve (not shown) by the rotation of a crank web 42. The oil pump 40 provides pressurized oil through a discharge passage 43, an oil filter 44, located on the inner side of the case L cover 22, an oil passage 46, formed inside the case L cover 22, and to required locations, such as the core of the crankshaft 7.

Figure 4:
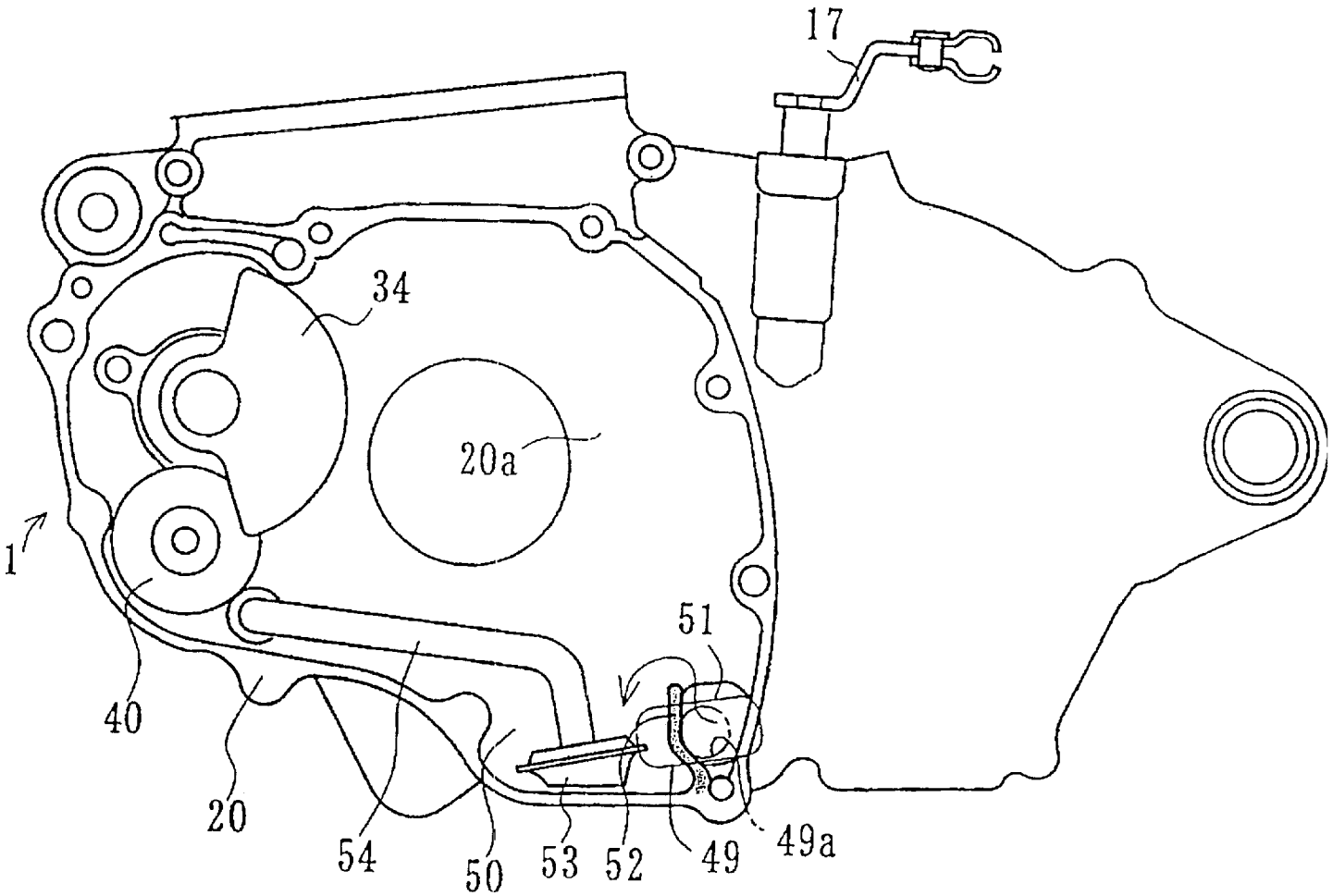
FIG. 4 is a side view showing a case L without a case L cover.
Figure 5:
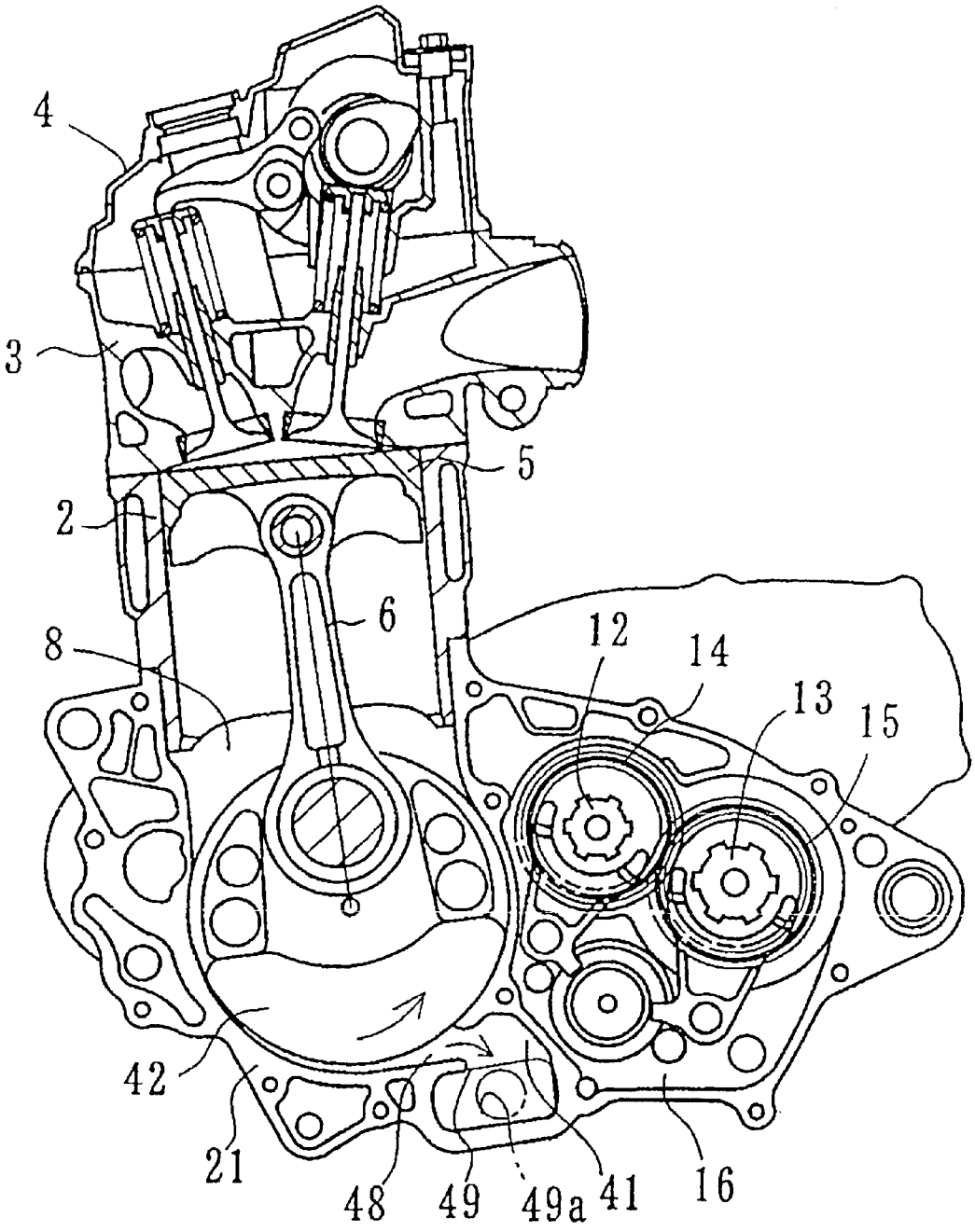
FIG. 5 is a sectional view showing the side of a case R acquired by dividing a crankcase into right and left halves.

FIG. 4 shows the side of the case L without the case L cover. FIG. 5 is a sectional view showing a divided plane on the side of the case R of the engine divided into right and left halves in the center. As shown in FIG. 5, an oil exhaust port 47 is opened to an oil reservoir 41 provided on the bottom of the case R 21.

A substantially wedge type oil passage 48 is formed between the oil exhaust port 47 and the web 42 of the crankshaft 7. The wedge gradually enlarges from the side of the outside periphery of a web 42 towards the oil exhaust port 47 and oil is sent from the oil passage 48 into the oil reservoir 41 by the rotation of the web 42.

The oil reservoir 41 and an oil pan, described later, are in communication with a lead valve 49 provided in a communicating passage. The lead valve 49 is a well-known structure. It is opened to the side of the oil pan on the bottom of the case L 20. When the piston 5 is lowered, oil is sent from an exit 49*a* to an oil exhaust port 51, and continues to the oil pan 50. The lead valve 49 is closed when the piston 5 is lifted and prevents oil from reversely flowing from the side of the oil pan.

As shown in FIG. 4, the oil pan 50 is located at the bottom of the case L 20. The oil pan 50 is provided outside a journal wall 20*a* forming the crankcase 8 shown in FIG. 2 in the case L 20 and is covered with the case L cover 22, as shown in FIG. 2. The oil exhaust port 51 is open at a lower corner in the rear of the journal wall 20*a* and communicates with the downstream side of the oil reservoir 41 via the lead valve 49.

The oil pan 50 and the crankcase 8 are partitioned by the journal wall 20*a* and communicate via the lead valve 49. Therefore, when the lead valve 49 is closed, the crankcase 8 is disconnected from the oil pan 50 and is sealed with the cylinder block 2, the cylinder head 3, and the cylinder head cover 4.

The oil exhaust port 51 is open to the oil pan 50 but partitioned with a small rib 52 integrally extending upwardly from the bottom of the oil pan 50. The upside of this small partition is open and when oil circulates from the oil exhaust port 51 into the small partition and exceeds the upper end of the rib 52, it flows into the oil pan 50.

A strainer 53 is provided in the oil pan 50. Oil in the oil pan 50 is sucked by the oil pump 40 through a suction pipe 54, to which the strainer 53 is connected. Oil is further sent from the oil pump 40 to various locations as described above in a state in which pressure is applied and various locations are lubricated.

Next, the action of this embodiment will be described. Oil sent to the crankshaft 7 and the piston 5 is circulated from the oil reservoir 41 via the lead valve 49 and the oil exhaust port 51 by the reciprocation of the piston 5 into the small partition. The small partition is formed in the oil pan 50 between the case L 20 and the case L cover 22. Oil circulating at this time includes a large amount of air. However, the air can be separated using the rib 52 between the oil exhaust port 51 on the downstream side of the lead valve 49 and the strainer 53. Therefore, even if the strainer 53 is arranged close to the lead valve 49, the compact layout of a lubricating device and the prevention of the inclusion of air is made possible, while the weight of the engine can be decreased and the lubrication structure can be decreased in size.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubrication structure for an engine comprising:

a first case, including a crankshaft, a connecting rod, and a piston;

a second case including an oil pan provided in a lower part of the engine;

said first case and said second case being independent of each other;

said first case being coupled to said second case via a lead valve;

said lead valve including a discharge opening for supplying oil to the oil pan; and a partition for separating air mixed in the oil, said partition being provided between a strainer in the oil pan and the lead valve.

2. The lubrication structure for an engine as set forth in claim 1, wherein said partition is a rib.

3. The lubrication structure for an engine as set forth in claim 2, wherein the oil loses air as it flows over said rib.

4. The lubrication structure for an engine as set forth in claim 1, and further including an oil exhaust port, wherein said lead valve exits into said oil exhaust port.

5. The lubrication structure for an engine as set forth in claim 4, wherein the oil pan receives oil from the oil exhaust port after passing over the partition.

6. The lubrication structure for an engine as set forth in claim 4, and further including an oil reservoir, wherein said oil reservoir communicates via the lead valve with said oil exhaust port.

7. The lubrication structure for an engine as set forth in claim 4, wherein said oil exhaust port holds air rich oil.

8. The lubrication structure for an engine as set forth in claim 4, wherein the oil exhaust port is open for oil to spill over.

9. A lubrication structure of an engine comprising:

a first case, including a crankshaft, a connecting rod, and a piston;

a second case including an oil pan provided in a lower part of the engine;

said first case and said second case being independent of each other;

said first case being coupled to said second case via a lead valve;

separating means for separating air mixed in oil, said separating means being positioned between a strainer and the lead valve.

10. The lubrication structure for an engine as set forth in claim 9, wherein said means for separating air mixed in oil is a partition.

11. The lubrication structure for an engine as set forth in claim 10, wherein said partition is a rib.

12. The lubrication structure for an engine as set forth in claim 11, wherein said partition is provided between the strainer in the oil pan and the lead valve.

13. The lubrication structure for an engine as set forth in claim 9, wherein an exit from the lead valve is separate from the oil pan.

14. The lubrication structure for an engine as set forth in claim 9, and further including an oil exhaust port, wherein said lead valve exits into said oil exhaust port.

15. The lubrication structure for an engine as set forth in claim 14, wherein the oil pan receives oil from the oil exhaust port after passing over the partition.

16. The lubrication structure for an engine as set forth in claim 15, and further including an oil reservoir, wherein said oil reservoir communicates via the lead valve with said oil exhaust port.

17. The lubrication structure for an engine as set forth in claim 16, wherein oil is sent from the oil reservoir to the oil exhaust port by the reciprocation of the piston.

18. The lubrication structure for an engine as set forth in claim 14, wherein said oil exhaust port contains air rich oil.

19. The lubrication structure for an engine as set forth in claim 14, wherein the oil exhaust port is open for oil to spill over.

* * * * *